US005119055A

United States Patent [19]

Kidd et al.

[11] Patent Number: 5,119,055

[45] Date of Patent: Jun. 2, 1992

[54] FLAT ELECTROMAGNETIC RELAY

[75] Inventors: Richard L. Kidd, Stow; Daniel J. Jilg, Warren, both of Ohio

[73] Assignee: General Motors Corporation, Detroit, Mich.

[21] Appl. No.: 747,235

[22] Filed: Aug. 19, 1991

[51] Int. Cl.[5] ..... H01H 51/22

[52] U.S. Cl. ..... 335/78; 335/128

[58] Field of Search ..... 335/78-85, 335/124, 104, 128, 202

[56] References Cited

U.S. PATENT DOCUMENTS 4,355,291 10/1982 Agatayama ..... 335/128
4,734,668 3/1988 Dittmann ..... 335/128
4,975,666 12/1990 Nobutoki ..... 335/78

*Primary Examiner*—Leo P. Picard
*Assistant Examiner*—Lincoln Donovan
*Attorney, Agent, or Firm*—Francis J. Fodale

[57] ABSTRACT

A flat electromagnetic relay comprises a lead frame having six stamped insert molded circuit leads, an armature frame pivotally supporting a balanced beam armature assembly that carries two contact bars, a coil assembly and an electromagnetic frame having two diagonally arranged pole wings which are on opposite sides and ends of the armature. The armature is biased into a first operative position where the contact bar at one shunts two circuit leads. When the coil is energized, the armature is pivoted into a second operative position where the contact bar at the other end shunts two other circuit leads. The armature assembly includes an armature having integral support pintles and an elastomeric oval shaped dome attached to one end of the armature so that it shrouds the contact bar at the one end and engages the lead frame to bias the contact bar at the one end of the armature away from the normally open contacts and the contact bar at the other end of the armature into engagement with the normally closed contacts.

4 Claims, 2 Drawing Sheets

FLAT ELECTROMAGNETIC RELAY

BACKGROUND OF THE INVENTION

This invention relates generally to electromagnetic relays and more specifically to flat electromagnetic relays which have a very small width when vertically oriented and or a very small height when horizontally oriented.

Flat electromaqnetic relays are already known from U.S. Pat. No. 4,010,433 granted to Hiromi Nishimura et al Mar. 1, 1977; U.S. Pat. No. 4,031,493 granted to Michael Van Der Wielen Jun. 21, 1977; U.S. Pat. No. 4,272,745 to Takashi Tanaka Jun. 9, 1981; U.S. Pat. No. 4,290,037 granted to Takashi Inagawa et al Sep. 15, 1981; U.S. Pat. No. 4,517,537 granted to Josef Weiser et al May 14, 1985 and from U.S. Pat. No. 4,684,909 granted to Michael Dittmann Aug. 4, 1987.

A flat electromagnetic relay is also already known from U.S. Pat. No. 5,038,123 granted to Christopher Alan Brandon Aug. 6, 1991. This patent which is incorporated herein by reference discloses a flat electromagnetic relay comprising a lead assembly having six stamped insert molded circuit leads, an armature frame pivotally supporting a balanced beam armature which carries two contact bars, a coil assembly and an electromagnetic frame having two diagonally arranged pole wings which are on opposite sides and ends of the armature. The armature is biased into a first operative position where the contact bar at one shunts two circuit leads. When the coil is energized, the armature is pivoted into a second operative position where the contact bar at the other end shunts two other circuit leads.

While this flat electromagnetic relay has many advantages it has a disadvantage in that the armature assembly is complicated, expensive to manufacture and does not lend itself to miniaturization very well.

SUMMARY OF THE INVENTION

The object of this invention is to provide an improved flat electromagnetic relay that has an armature assembly that is simple in construction, compact and inexpensive to manufacture.

A feature of this invention is that it has an elastomeric spring in the form of an oval shaped dome that shrouds a contact bar at one end of the armature and biases it away from the normally open contacts of the relay.

Other objects and features of the invention will become apparent to those skilled in the art as disclosure is made in the following detailed description of a preferred embodiment of the invention which sets forth the best mode of the invention contemplated by the inventors and which is illustrated in the accompanying sheet(s) of drawing.

DETAILED DESCRIPTION OF THE PREFERRED EMBODIMENT

Figure 1:
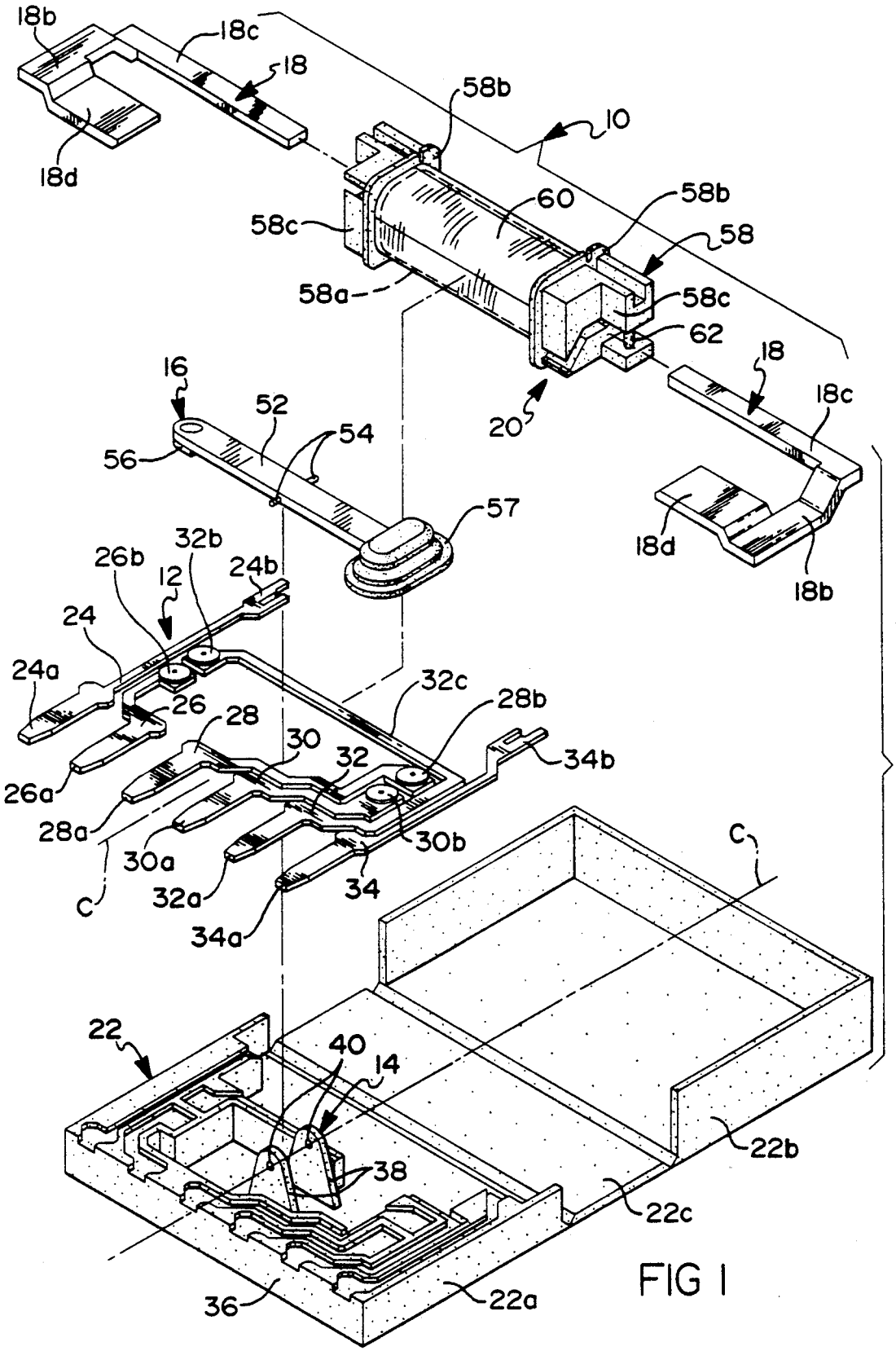
FIG. 1 is an exploded perspective view of a flat electromagnetic relay in accordance with the invention.

Referring now to the drawing and more particularly to FIG. 1, a flat electromagnetic relay in accordance with the invention is shown generally at 10 as comprising a lead assembly 12, an armature frame 14, an armature assembly 16, an electromagnetic frame 18, a coil assembly 20 and a case or housing 22.

The lead assembly 12 comprises an arrangement of six circuit leads 24, 26, 28, 30, 32 and 34 which are stamped from a single flat sheet of high copper content alloy or other suitable electrically conductive material. The stamped circuit leads are preferably insert molded in a generally U-shaped thermoplastic lead frame 36 of high temperature, high strength thermoplastic material such as polyetherimide. Alternatively the stamped circuit leads could be placed in surface cavities of an already molded lead frame 36 and suitably secured in the surface cavities by heat staking or other suitable techniques. In any event, the lead frame 36 is preferably molded an integral part of the housing 22 and more particular as an integral part of the housing base **22*a* to reduce manufacturing cost of the relay 10**.

Figure 2:
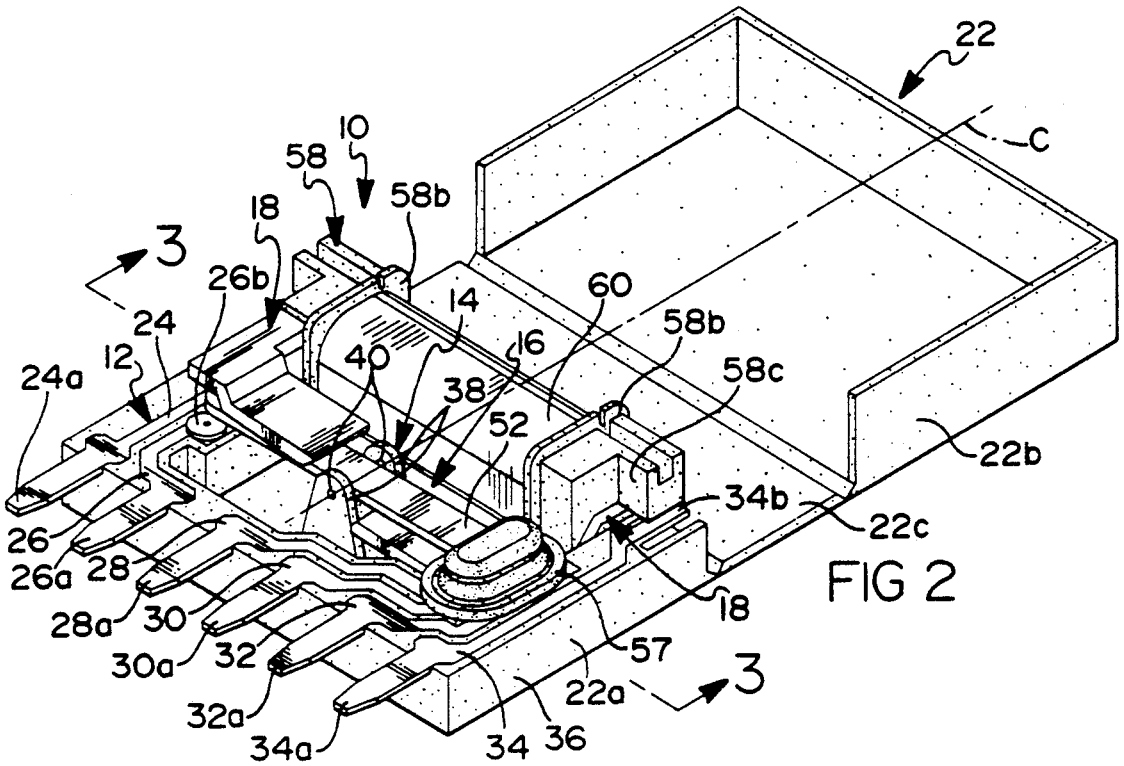
FIG. 2 is a perspective view of the flat electromagnetic relay which is shown in FIG. 1.

The circuit leads 24, 26, 28, 30, 32 and 34 are shaped to provide six male terminal blades **24*a*, 26*a*, 28*a*, 30*a*, 32*a* and 34*a* projecting from an edge of the lead frame 36 portion of the housing base 22*a* as best shown in FIG. 2. The six male terminal blades are coplanar, identical in width, and evenly spaced. The thermoplastic lead frame 36 electrically isolates the six circuit leads from one another while binding them into the housing base 22*a* upon which the electromagnetic relay 10** is constructed.

The six circuit leads 24, 26, 28, 30, 32 and 34 consist of three pairs of functionally related circuit leads that are arranged so that their respective pairs of male terminal blades **24*a*, 26*a*, 28*a*, 30*a*, 32*a* and 34*a* each have their respective terminal blades on opposite sides of and equidistant from an imaginary center line C of the lead frame base 36 and relay 10 . The functionally related pairs of male terminal blades are end terminal blades 24*a* and 34*a* of circuit leads 24 and 34 that form part of an energizing circuit for the coil assembly 20; intermediate terminal blades 26*a* and 32*a* of circuit leads 26 and 32 that form part of a first, normally closed switching circuit; and middle terminal blades 28*a* and 30*a* of circuit leads 28 and 30 that form part of a second, normally open switching circuit The circuit leads 24 and 34 for the end terminal blades 24*a* and 34*a* are located on the two respective legs of the generally U-shaped lead frame 36 and terminate in slotted ends 24*b* and 34*b* that overhang the respective legs of the U-shaped frame 36. These slotted ends 24*b* and 34*b* provide electrical connections to the coil of the coil assembly 20 for completing the energizing circuit for the coil assembly 20** as explained below.

The circuit leads 26 and 32 for the intermediate terminal blades **26*a* and 32*a* are also located on the two respective legs of the U-shaped lead frame 36. The circuit lead 32, however has a cross-over portion 32*c* that extends from one leg to the other so that the circuit leads 26 and 32 both have terminal ends that carry stationary contacts 26*b* and 32*b* located next to each other on the same leg of the U-shaped frame 36; in this particular case, the left hand leg as viewed in FIGS. 1, 2 and 3. The stationary contacts 26*b* and 32*b* are positioned where they can be closed by a movable contact bar at one end of the armature assembly 16** and thus form part of a first, normally closed switching circuit.

Figure 3:
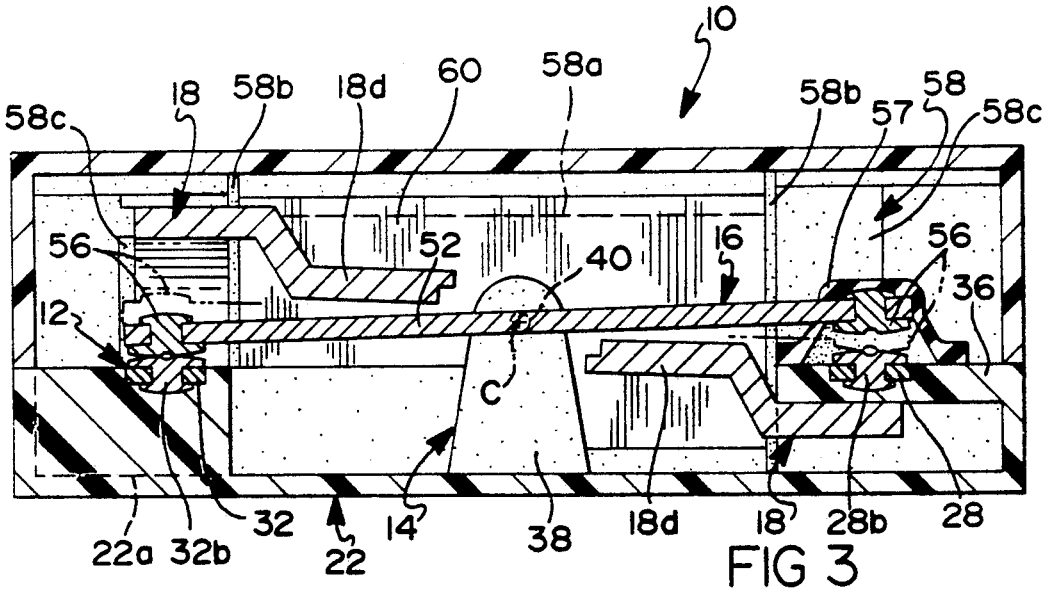
FIG. 3 is a section taken substantially along the line 3—3 of FIG. 2 looking in the direction of the arrows.

The circuit leads 28 and 30 of the middle terminal blades **28*a* and 30*a* are both located on the opposite leg of the U-shaped lead frame 36 and their terminal ends carry stationary contacts 28*b* and 30*b* that are located next to each other on this opposite leg, that is, the right hand leg of the U-shaped frame 36 as viewed in FIGS. 1, 2 and 3. The stationary contacts 28***b* and 30*b* are positioned where they can be closed by a movable contact bar at the opposite end of the armature assembly 16 and thus form part of a second, normally open switching circuit because the armature assembly 16 operates in a seesaw fashion closing one pair of stationary contacts while simultaneously opening the other and vice versa.

It should be noted that the six circuit leads 24, 26, 28, 30, 32 and 34 arranged in the reversible pattern described above are all planar and also arranged in a coplanar configuration including the terminal blades 24*a*, 26*a*, 28*a*, 30*a*, 32*a* and 34*a*. This facilitates assembly of the lead assembly 12 particularly where the circuit leads are insert molded in a lead frame 36 that is molded as an integral part of the housing base 22*a*.

The armature frame 14 supports and positions the armature assembly 16. It comprises two spaced stanchions 38 that are molded as an integral part of the housing base 22*a* to reduce manufacturing costs. The stanchions 38 have aligned holes 40 that receive attachment pintles of the armature assembly 16 for mounting the armature assembly 16 in an operative position in the housing 22.

The armature assembly 16 is a symmetrical beam that comprises an armature 52 having integral support pintles 54, two contact bars 56 and an elastomeric oval shaped dome 57. The oval shaped dome 57 is attached to one end of the armature 52 so that it shrouds the contact bar 56 and engages the lead frame 36 to bias the contact bar 56 away from the normally open contacts 28*b* and 30*b* as shown in solid lines in FIG. 3. The armature assembly 16 is mounted on the armature frame 14 by spreading the stanchions 38 apart and inserting the integral support pintles 54 in the aligned holes 40 which are then locked in place when the stanchions are released. When the armature assembly 16 is secured in this manner, the support pintles 54 establish an axis of rotation for the armature assembly 16 and the elastomeric oval shaped dome 57 acts as a return spring which biases the armature assembly 16 in a first operative position. In this first operative position which is shown in solid lines in FIG. 3, the left contact bar 56 bridges the contacts 26*b* and 32*b* of the first, normally closed switching circuit while the right contact bar is spaced from the contacts 28*b* and 30*b* of the second, normally open switching circuit.

The armature 52 is a strip of low carbon, magnetically soft steel which when exposed to an electromagnetic field produced by the electromagnetic frame 18 in conjunction with the coil assembly 20, is subjected to a resultant Lorentz force that causes the armature 52 to pivot toward the electromagnetic frame 18 to a second operative position, compressing and further biasing the elastomeric dome 57. In this second operative position which is shown in dotted lines in FIG. 3, the right contact bar 56 bridges the pair of stationary contacts 28*b* and 30*b* of the normally open switching circuit while the other pair of stationary contacts 26*b* and 32*b* are simultaneously opened. Thus each of the contact bars 56 which are attached to the opposite ends of the armature 52 spans or closes one pair of stationary contact 26*b* and 32*b* or 28*b* and 30*b* while the other pair is simultaneously opened.

The coil assembly 20 generates magnetic flux in the electromagnetic frame 18 and the armature 52 when the electromagnetic relay 10 is energized. The coil assembly 20 comprises a molded plastic bobbin 58, a coil 60 consisting of several consecutive wraps of insulated wire wound around the plastic bobbin 58, and solder pins 62 that are carried by the plastic bobbin for connecting the ends of the coil to the circuit leads 24 and 32. The wire for coil 60 is preferably a fine gauge, 35 to 36 AWG typical, solid core copper wire with high temperature insulation.

The bobbin 58 comprises a thin wall, square shaped tube 58*a* with enlarged square flanges 58*b* located at each end of the tube. The inside of the tube 58*a* is also square shaped. The flanges 58*b* on each end of the tube 58*a* contain and protect the sides of the coil 60.

The exterior sides of the flanges 58*b* have slotted mounting lugs 58*c* for mounting the coil assembly 20 on the U-shaped lead frame 36 behind the armature frame 14 and armature assembly 16. The bobbin 58 is mounted on the base 22*a* of the housing 22 by sliding the legs of the integral U-shaped lead frame 36 into the respective slotted mounting lugs 58*c* of the bobbin 58. Each of the slotted mounting lugs 58*c* carries one of the solder pins 62 so that the solder pins 62 are inserted into the slotted ends 24*b* and 34*b* of the circuit leads 24 and 34 to automatically establish electrical connections to the coil 60 when the bobbin assembly 20 is attached to the housing base 22*a*.

The electromagnetic frame 18 concentrates and directs the magnetic flux generated by the coil assembly 20 to opposite side ends of the armature 52 so that the resultant Lorentz force of the energized coil produces a moment which pivots the armature 52 into engagement with the electromagnetic frame 18, i e. from the solid line position to the dotted line position shown in FIG. 3.

The electromagnetic frame 18 comprises two identical "U" shaped steel pieces 18*b* that are made of low carbon, magnetically soft, steel. Each of the U-shaped electromagnetic frame pieces 18*b* has a long, narrow core leg 18*c* of rectangular cross section and a short, wide wing 18*d* formed from the opposite leg to act as a pole piece.

The electromagnetic frame pieces 18*b* are mounted on the coil assembly 20 by inserting their respective long, narrow core legs 18*c* into opposite ends of the square shaped tube 58*a* of the bobbin 58 which then holds the core legs 18*c* one on top of the other in a parallel overlapping arrangement. This mounting of the electromagnetic frame pieces 18*b* on the coil assembly 20 positions the short, wide wings 18*d* parallel to each other in a diagonal arrangement in front of the coil assembly 20 as best shown in FIGS. 2 and 3. When the relay 10 is assembled, the wings 18*d* are positioned on diagonally opposite sides and ends of the armature 52 with air gaps between the wings 18*d* and the armature 52 when the coil 60 is de-energized as shown in solid lines in FIG. 3.

The electromagnetic relay 10 includes a case or housing 22 to protect the components of the relay from physical damage from handling, installation, and environmental contamination. This case or housing 22 comprises the thermoplastic base 22*a* discussed above and an integral cover 22*b* and back plate 22*c*. The cover 22*b* is attached to the base 22*a* in a double hinge arrangement by the back plate 22*c* that has a first hinge connection with the base 22*a* at one edge and a second hinge connection with the cover 22*b* at an opposite edge. This double hinge arrangement allows the cover 22*b* and the back plate 22*c* to be folded down to provide total access to the open back of the base 22*a*. This feature facilitates assembly of the relay components to the base 22*a*, particularly the assembly of the electromagnetic frame 18 and coil assembly 20 sub-assembly.

The relay 10 is assembled in the following manner. As indicated earlier, the lead frame 36 and armature support 14 are molded as a n integral part of the housing 22 to save manufacturing cost. The stamped circuit leads 24,26,28,30,32 and 34 are also preferably insert molded in the integral lead frame 36 for further cost savings. With the cover 22*b* in the open position shown in FIGS. 1 and 2, the armature assembly 16 is then mounted on the armature support 14 by spreading the stanchions 38, inserting the pintles 54 into the aligned holes 40 and then releasing the stanchions 38 to hold the pintles 54 in place. The cover is then folded down to expose the entire open back of the housing base 22*a*. The electromagnetic frame 18 is then assembled to the coil assembly 20 to form a sub-assembly that is then slid into the housing base 22*a* and onto the end of the lead frame 36 through the open back until it reaches the position shown in FIG. 2. This automatically completes the energizing circuit for the coil of the coil assembly as indicated above. The cover 22*b* is then closed and locked in the closed position (not shown) to complete the relay 10. The closed cover may be locked in any suitable manner such as by cooperating lock nibs and lock arms that are formed as parts of the base 22*a* and the cover 22*b* respectively.

When the relay 10 is completed it may be plugged in either frontwards or backwards (i.e. as shown in the drawing or turned 180 degrees about the centerline C from this position) because the middle terminal blades 28*a*, 30*a* are always in the normally closed circuit, the intermediate terminal blades 26*a*, 32*a* are always in the normally open circuit, and the end terminal blades 24*a*, 34*a* are always in the energizing circuit.

We wish it to be understood that we do not desire to be limited to the exact details of construction shown and described, for obvious modifications will occur to a person skilled in the art.

The embodiments of the invention in which an exclusive property or privilege is claimed are defined as follows:

1. In a flat electromagnetic relay having at least six circuit leads that respectively provide at least six, coplanar, evenly spaced male terminal blades, the circuit-leads including a first pair of normally open circuit leads having a first pair of said terminal blades, a second pair of normally closed circuit leads having a second pair of said terminal blades; and a pair of energizing circuit leads having a third pair of said terminal blades, the first and second pairs of circuit leads having respective ones of first and second pairs of stationary contacts that are next to each other, an armature assembly that is pivotally mounted for movement between first and second operative positions, and that include movable contact bars at opposite ends so that one contact bar bridges the first pair of contacts in the first operative position and the other contact bar bridges the second pair of contacts in the second operative position, a coil assembly electrically connected to the pair of energizing leads, an electromagnetic frame comprising a core leg which is inside a coil of the coil assembly and wings that are adjacent opposite ends of the armature assembly, the coil assembly when energized positioning the armature assembly in one of the first and second operative positions, and spring means biasing the armature assembly in another of the first and second operative positions, the improvement comprising:

the armature assembly comprising an armature, an elastomeric oval shaped dome attached to one end of the armature so that it shrouds the contact bar at the one end and engages the lead frame to bias the contact bar at the one end of the armature away from the normally open contacts and the contact bar at the other end of the armature into engagement with the normally closed contacts.

2. The flat electromagnetic relay as defined in claim 1 wherein the improvement further comprises the relay having stanchions with aligned holes and the armature having cooperating integral support pintles for pivotally mounting the armature assembly.

3. The flat elastomeric relay as defined in claim 2 wherein the improvement further comprises the armature assembly being pivotally mounted on the stanchions by spreading the stanchions apart and inserting the integral support pintles in the aligned holes which are then locked in place when the stanchions are released.

4. The flat elastomeric relay as defined in claim 3 wherein the improvement further comprises a housing and the stanchions being molded as an integral part of the housing.

* * * * *